US009220381B2

(12) United States Patent
Akiyoshi et al.

(10) Patent No.: US 9,220,381 B2
(45) Date of Patent: Dec. 29, 2015

(54) HAND DRYER

(75) Inventors: Masao Akiyoshi, Chiyoda-ku (JP); Fumikazu Matsuura, Chiyoda-ku (JP); Hitoshi Kikuchi, Chiyoda-ku (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 411 days.

(21) Appl. No.: 13/808,353

(22) PCT Filed: Jan. 18, 2011

(86) PCT No.: PCT/JP2011/000223

§ 371 (c)(1), (2), (4) Date: Jan. 4, 2013

(87) PCT Pub. No.: WO2012/017570

PCT Pub. Date: Feb. 9, 2012

(65) Prior Publication Data

US 2013/0104413 A1 May 2, 2013

(30) Foreign Application Priority Data

Aug. 5, 2010 (JP) ..... 2010-175912

(51) Int. Cl.
*A47K 10/48* (2006.01)
*B05B 1/04* (2006.01)
(Continued)

(52) U.S. Cl.
CPC . *A47K 10/48* (2013.01); *B05B 1/04* (2013.01); *F26B 21/004* (2013.01)

(58) Field of Classification Search
CPC ..... B05B 1/044; F26B 21/004; A45D 20/08; A45D 20/10; A45D 20/12; A45D 20/122; A45D 20/124
USPC ..... D28/54.1; 392/380, 381
See application file for complete search history.

(56) References Cited

U.S. PATENT DOCUMENTS 7,412,781 B2 * 8/2008 Mattinger et al. ..... 34/96
8,347,522 B2 * 1/2013 Dyson et al. ..... 34/90
(Continued)

FOREIGN PATENT DOCUMENTS

JP 49-037865 U 4/1974
JP 2720722 B2 3/1998
(Continued)

OTHER PUBLICATIONS

Office Action (Notification of Reason for Refusal) issued on Oct. 8, 2014, by the Korean Patent Office in corresponding Korean Patent Application No. 10-2013-7002199, and an English Translation of the Office Action. (6 pages).
(Continued)

*Primary Examiner* — David J Laux
(74) *Attorney, Agent, or Firm* — Buchanan Ingersoll & Rooney PC

(57) ABSTRACT

To provide a hand dryer that is capable of reducing the amount of noise without reducing the drying performance, and is capable of preventing foreign substances from entering from an air outlet thereof. A hand dryer is configured to blow water off hands with airflow emitted from nozzles. The hand dryer includes a hand insertion section that is open toward the outside, and the nozzles disposed on wall surfaces of the hand insertion section. A nozzle hole at the distal end of each of the nozzles is a wave-shaped slit.

13 Claims, 4 Drawing Sheets

(51) Int. Cl.
*F26B 21/02* (2006.01)
*F26B 21/00* (2006.01)

(56) References Cited

U.S. PATENT DOCUMENTS

| | | | | |
|---|---|---|---|---|
| 2007/0144034 | A1* | 6/2007 | Kameishi | 34/523 |
| 2008/0216342 | A1* | 9/2008 | Kameishi et al. | 34/202 |
| 2009/0034946 | A1* | 2/2009 | Caine et al. | 392/380 |

FOREIGN PATENT DOCUMENTS

| | | | |
|---|---|---|---|
| JP | 10-113304 | A | 5/1998 |
| JP | 11-000283 | A | 1/1999 |
| JP | 4087894 | B2 | 5/2008 |
| JP | 2009-523047 | A | 6/2009 |
| KR | 10-2007-0032621 | A | 3/2007 |

OTHER PUBLICATIONS

International Search Report (PCT/ISA/210) issued on Feb. 15, 2011, by the Japanese Patent Office as the International Searching Authority for International Application No. PCT/JP2011/000223.
UK Office Action dated Jul. 9, 2015 issued in the corresponding UK Patent Application No. 1301553.2 (3 pages).
Korean Notification of Reason of Refusal dated Apr. 30, 2015 issued in the corresponding Korean Patent Application No. 10-2013-7002199 and English translation (8 pages).

* cited by examiner

HAND DRYER

TECHNICAL FIELD

The present invention relates to a hand dryer that dries wet hands with airflow emitted from a nozzle hole.

BACKGROUND ART

There are hand dryers that dry wet hands with airflow emitted from a nozzle hole. Compared to paper towels and rental towels, these hand dryers have lower running costs, are more hygienic due to being used without contact with the hands, and are easy to be maintained.

However, such a hand dryer is configured to blow airflow generated by a fan or the like from an air outlet thereof (corresponding to a nozzle hole described below). Therefore, if the velocity of the airflow is increased so as to improve the drying performance, the amount of noise of the hand dryer is increased.

As a hand dryer that solves the above problem, for example, there is "a hand dryer including: a hand insertion section into which hands can be inserted through the open front and sides of a case thereof; outlet nozzles that are provided one on each of upper and lower surfaces of the hand insertion section, and have a nozzle hole having a cross-sectional shape of a cubic curve so as to emit high-pressure air as a high-speed wind; and a high-pressure air generating unit configured to send high-pressure air to the outlet nozzles" (see Patent Literature 1).

CITATION LIST

Patent Literature

Patent Literature 1: Japanese Patent No. 2720722 (page 1)

SUMMARY OF INVENTION

Technical Problem

There is a method for reducing the amount of noise in hand dryers such as the one disclosed in Patent Literature 1 without reducing the drying performance thereof. This method reduces the velocity of airflow and increases the air volume. In order to increase the air volume, the area of the nozzle hole needs to be increased. However, in the hand dryer of Patent Literature 1, the nozzle hole has a substantially chrysanthemum-like shape. Therefore, if the area of the nozzle hole is increased, the radius thereof becomes excessively large. Thus, foreign substances may enter the hand dryer from the nozzle hole.

The present invention has been made to overcome the above problems, and aims to provide a hand dryer that is capable of reducing the amount of noise without reducing the drying performance, and is capable of preventing foreign substances from entering from a nozzle hole thereof.

Solution to Problem

A hand dryer according to the present invention is configured to blow water off hands with airflow emitted from a nozzle. The hand dryer includes a hand insertion section that is open toward the outside, and the nozzle disposed on a wall surface of the hand insertion section. A nozzle hole at the distal end of the nozzle is a wave-shaped slit.

Advantageous Effects of Invention

According to the present invention, it is possible to provide a hand dryer that is capable of reducing the amount of noise without reducing the drying performance due to a nozzle hole having a wave shape, and is capable of preventing foreign substances from entering from the nozzle hole due to the nozzle hole having a slit shape.

DESCRIPTION OF EMBODIMENTS

In the following, hand dryers according to exemplary embodiments of the present invention are described in detail with reference to the drawings.

Embodiment 1

Figure 1:
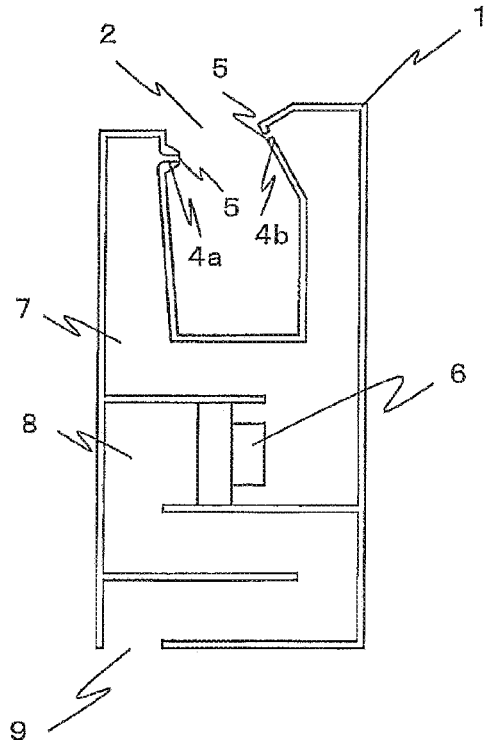
FIG. 1 is a side cross-sectional view of a hand dryer according to Embodiment 1 of the present invention.
Figure 2:
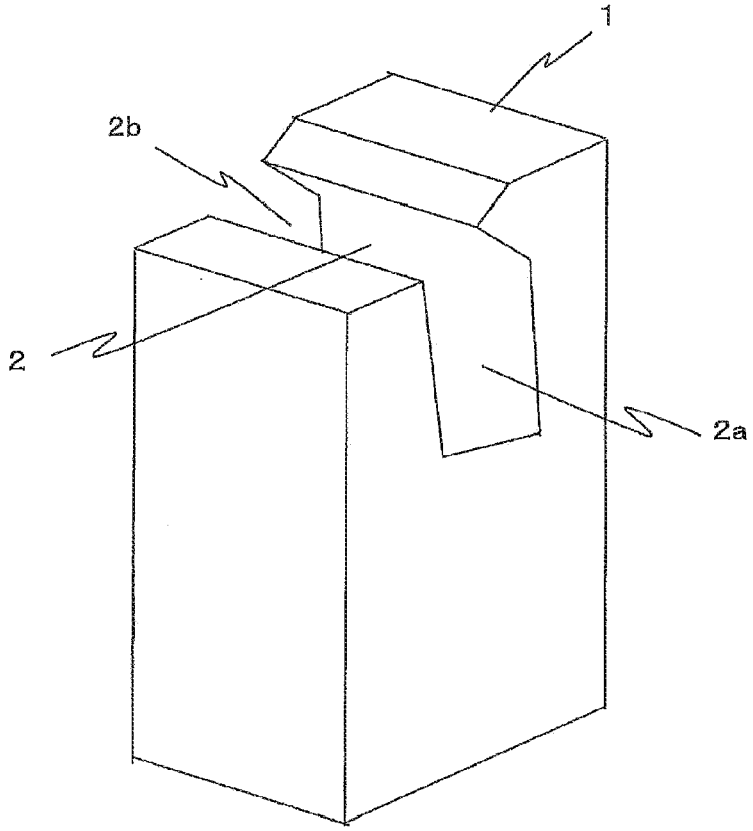
FIG. 2 is an outline perspective view of the hand dryer according to Embodiment 1 of the present invention.

FIG. 1 is a side cross-sectional view of a hand dryer according to Embodiment 1 of the present invention. FIG. 2 is an outline perspective view of the hand dryer according to Embodiment 1 of the present invention.

It is to be noted that, in all the drawings described below, the upper part of the drawing corresponds to the upper part of the hand dryer or the components thereof, and the lower part of the drawing corresponds to the lower part of the hand dryer or the components thereof.

Referring to FIG. 1, the hand dryer of Embodiment 1 of the present invention includes a case 1 defining the outline of the hand dryer main body, and a hand insertion section 2 into which hands can be inserted through the open top and sides of the case 1. As illustrated in FIG. 2, opening portions 2*a* and 2*b* are formed in opposing lateral sides of the hand insertion section 2 for easy insertion of hands. It is to be noted that the opening portions 2*a* and 2*b* in the opposing lateral sides may not be provided. Even if the opening portions 2*a* and 2*b* are not provided, the hand dryer can achieve the same drying performance as that having the opening portions 2*a* and 2*b*. An inner wall of the hand insertion section 2 is impregnated with a water-repellent coating of the silicone series, the fluorine series or the like; a hydrophilic coating of titanium oxide or the like; or an antimicrobial agent, for example. This reduces adhesion of contaminants to the inner surface and prevents the growth of bacteria.

Further, as illustrated in FIG. 1, a nozzle 4*a* is provided on an outer wall surface on the front side (corresponding to a first wall surface in the present invention) of the hand insertion section 2, and a nozzle 4*b* is provided on an outer wall surface on the rear side (corresponding to a second wall surface in the present invention) of the hand insertion section 2. The nozzles 4*a* and 4*b* are positioned and oriented so as to oppose each other. A nozzle hole 5 defining a slit having a wave-shape is formed at a distal end of each of the nozzles 4*a* and 4*b* such that the longitudinal direction of the nozzle hole 5 is substantially parallel to the lateral direction of the hand dryer. Airflow passes through the nozzle hole 5 and flows into the hand insertion section 2 so as to dry hands. Also, since the two nozzles 4*a* and 4*b* are disposed so as to oppose each other, it is possible to blow air onto both the palm and back of the hands (not shown) inserted in the hand insertion section 2. It is to be noted that, in order to reduce the hand drying time, the air velocity and the distance between the nozzles 4*a* and 4*b* are optimally set.

In order to cause air to flow out of the nozzle hole 5 into the hand insertion section 2, the pressure at the entrance side of the nozzle hole 5 needs to be increased. As a pressure device used for that purpose, as illustrated in FIG. 1, a blower 6 (corresponding to an airflow generating unit in the present invention) is provided inside the case 1. The blower 6 mainly includes a motor and a fan. Examples of the blower 6 include a blower that has a drive circuit (not shown) for driving a DC brushless motor and has a turbofan (not shown) rotated by the DC brushless motor.

In the case 1, a space 8 on the upstream side of the blower 6 and a space 7 on the downstream side of the blower 6 are separated from each other by the blower 6. The air flowing from an air inlet 9 is converted into high-pressure airflow by the blower 6. The airflow flowing out of the blower 6 is branched into two paths in the space 7 at the downstream side of the blower 6 so as to flow into the respective nozzle holes 5. It is to be noted that the space 8 at the upstream side of the blower 6 is a bent flow path. Therefore, the space 8 slightly resists the air flowing from the air inlet 9, but has an effect of preventing noise generated in the blower 6 from being emitted to the surrounding area. A drain outlet (not shown) for discharging water spattered from the hands is provided at the bottom of the hand insertion section 2. The drain outlet is connected to a drain pipe (not shown). The drain pipe is connected to a drain tank (not shown) for receiving the drain water flowing out of the drain pipe.

Further, a sensor (not shown) for detecting hands is provided on the front side and the rear side of the hand insertion section 2 near the entrance thereof and on the front side and the rear side of the hand insertion section 2 at the lower part thereof. Further, a control circuit (not shown) is provided that processes signals from this sensor, and appropriately controls operations and the like of the blower 6 on the basis of the processing results.

The entire configuration of the hand dryer of Embodiment 1 is not limited to that described above, and may have any configuration as long as airflow can be emitted from the nozzle hole 5.

Next, a description will be given of operations of the hand dryer according to Embodiment 1.

For example, when wet hands are inserted into the hand insertion section 2, the sensor detects the hands. Then, a hand detection signal is transmitted to the control circuit (not shown). The control circuit starts the blower 6, and thus the turbofan (not shown) rotates. Then, the airflow suctioned from the air inlet 9 passes through the space 8 and flows into the blower 6, by which the airflow is converted into high-pressure airflow. The high-pressure airflow is divided into two airflows at the space 7 on the upstream side, and the airflows are emitted from the nozzle holes 5 of the nozzles 4*a* and 4*b*. The emitted airflows hit the palm and back of the hands inserted in the hand insertion section 2 so as to blow water off the hands and evaporate the water. Then, when the user's hands are removed from the hand insertion section 2, the sensor stops outputting a hand detection signal. Thus, the control circuit stops the blower 6.

In the above-described hand dryer, there are three factors that generate loud noise, namely, the nozzle holes 5 through each of which high-speed airflow flows in the vicinity of a stationary wall surface, the hand insertion section 2 where the airflows emitted from the respective nozzle holes 5 collide with each other, and the blower 6 having a high-speed rotating body. Since the blower 6 is accommodated inside the case 1, the blower 6 affects the overall volume of the noise less than the other two components. Accordingly, in order to reduce the amount of the noise of the hand dryer, the amount of the noise of the nozzle holes 5 and the hand insertion section 2 needs to be reduced. The volume of the noise in the nozzle holes 5 and the noise due to the high-speed airflows from the nozzle holes 5 colliding with each other in the hand insertion section 2 are significantly affected by the shape of the nozzle holes 5.

Figure 3:
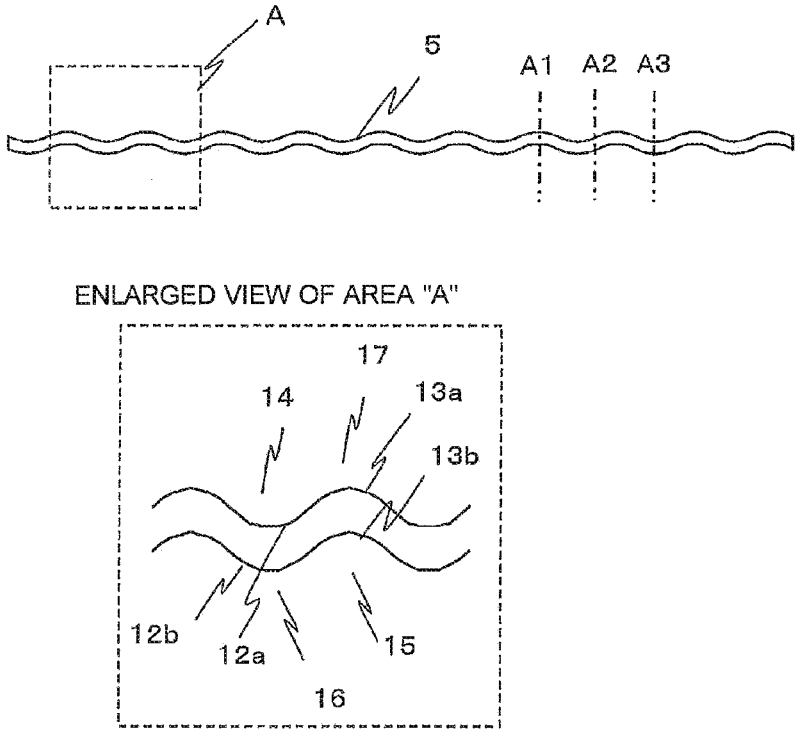
FIG. 3 is a front view of a nozzle hole of the hand dryer according to Embodiment 1 of the present invention.

FIG. 3 is a front view of the nozzle hole 5 of the hand dryer according to Embodiment 1 of the present invention.

As illustrated in FIG. 3, the nozzle hole 5 is a wave-shaped (a substantially sine-wave-shaped) slit having a plurality of peaks and valleys in a longitudinal direction thereof. Further, as illustrated in an enlarged view of an area "A", each valley portion of the nozzle hole 5 is defined by an outer edge 12*a* at the upper end and an outer edge 12*b* at the lower end. A space 14 is a space surrounded by the outer edge 12*a*. Each peak portion of the nozzle hole 5 is defined by an outer edge 13*a* at the upper end and an outer edge 13*b* at the lower end. A space 15 is a space surrounded by the outer edge 13*b*.

Next, a description is given of the noise reducing effect by the wave-shaped nozzle hole 5.

The source of the noise generated upon emission of a high-speed airflow from the nozzle hole 5 is generally divided into three sources. The first is boundary layer noise that is generated from a boundary layer formed on the surface of the nozzle hole 5. The second is vortex noise that is generated due to emission of a vortex from a downstream exit of the nozzle hole 5. The third is jet noise generated from a shear flow of a turbulent diffusion layer. The turbulent diffusion layer is generated due to the difference in velocity between the main flow in a potential core, which is not affected by agitation, in the airflow emitted from the nozzle hole 5, and still air therearound.

With regard to the jet noise, the amount of noise can be reduced by reducing the difference in velocity between the surrounding still air and the high-speed airflow. That is, in the hand dryer of Embodiment 1 of the present invention, the difference in velocity between the airflow flowing from the nozzle hole 5 and the still air therearound is problematic.

As mentioned above, the nozzle hole 5 of Embodiment 1 of the present invention has a wave shape. Further, there is the space 14 between the adjacent peak portions, and there is the space 15 between the adjacent valley portions. For example, in the space 14, energy is supplied by the airflow emitted from the clearance between 12*a* and 12*b* of the nozzle hole 5, so that airflow is induced. Thus, compared to the case of a linear nozzle hole, the velocity of the induced airflow in the space 14 is higher than that in the space around the linear nozzle hole. As a result, compared to the case of the linear nozzle hole, the difference in velocity between the high-speed airflow directly emitted from the nozzle hole 5 and the airflow in the surrounding space is smaller, which reduces the generation of jet noise. Similarly, as for the airflow in the space 15, the difference in velocity between the high-speed airflow directly emitted from the nozzle hole 5 and the airflow in the space 15 is small, which reduces the generation of jet noise.

A space 16 under the outer edge 12*b* is not surrounded by the nozzle hole, and therefore the difference in velocity between the high-speed airflow directly emitted from the nozzle hole 5 and the surrounding airflow therein is large as in the case of the linear nozzle hole. Accordingly, the amount of noise is not reduced. However, since the space 14 where the amount of noise is reduced and the space 16 where the amount of noise is not reduced are formed in the vertical direction of the nozzle hole 5, the phases of the flow variations (the pressure variations), which constitute the noise source, do not match each other in the hand insertion section 2 in the vertical direction. Accordingly, the correlation area of sounds is reduced, and therefore the amount of noise can be reduced. On the other hand, in the case of the linear nozzle hole, the phases of the airflows match each other in both the vertical direction and the width direction of the nozzle hole, and the matching phases increase the amount of noise. It is to be noted that the state of noise in a space 17 over the outer edge 13*a* is similar to the state of the noise in the space 16 described above.

Figure 4:
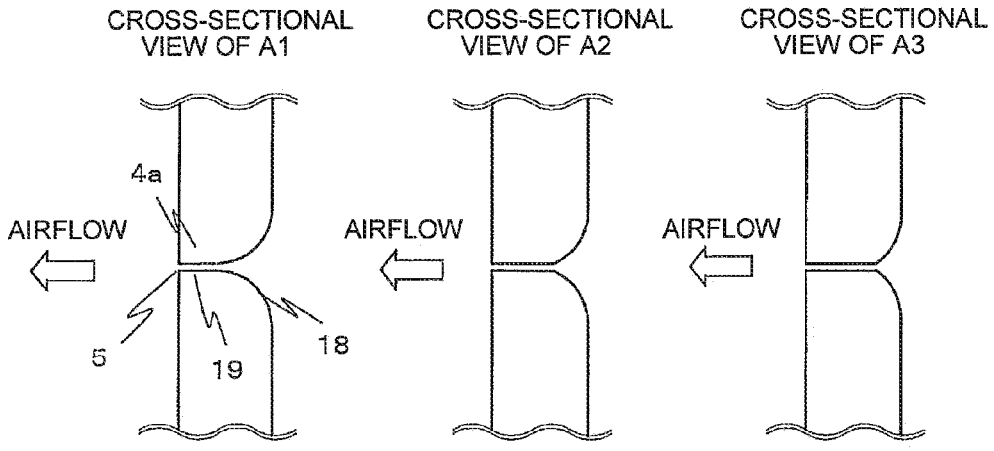
FIG. 4 illustrates cross-sectional views taken along the lines A1, A2, and A3, respectively, of FIG. 3.

FIG. 4 illustrates cross-sectional views taken along the lines A1, A2, and A3, respectively, of FIG. 3.

The line A1 is a line passing through the center of the peak portion of the nozzle hole 5; A2 is a line passing through the boundary between the peak portion and the valley portion; and A3 is a line passing through the center of the valley portion. A description will be given of the cross-sectional shape of the nozzle 4*a* with reference to the cross-sectional view taken along the line A1. In FIG. 4, the airflow flows to the paper surface of the nozzle 4*a*. In order to reduce pressure loss, the nozzle 4*a* is round-chamfered at a nozzle entrance 18 such that the size of the clearance is gradually reduced toward the downstream side of the airflow. Thus, the air flowing through the clearance is gradually accelerated due to the reduction in the size of the clearance. Between the nozzle entrance 18 and the nozzle hole 5, there is a linear portion 19. The linear portion 19 is a continuous clearance having a constant gap size. The air having been accelerated at the nozzle entrance 18 passes through the linear portion 19 and is emitted from the nozzle hole 5 into the hand insertion section 2.

On the round-chamfered surfaces of the nozzle entrance 18, the velocity of the airflow is substantially the same from portions near the upper and lower wall surfaces to the center thereof. However, as the airflow approaches the nozzle hole 5 while passing through the linear portion 19, a parabolic velocity distribution is formed in which the velocity is maximized near the center and is lower near the upper and lower wall surfaces. Since the amount of the boundary noise decreases as the velocity of the airflow near the wall surface of the nozzle hole 5 decreases, the length of the linear portion 19 is increased so as to achieve the velocity distribution described above. Thus, the amount of noise is reduced. However, if the length of the linear portion 19 is excessively long, a pressure loss due to friction between the high-speed air and the stationary wall surface is increased, thus the linear portion 19 needs to have an appropriate length. The experiments conducted by the authors showed that the appropriate length of the linear portion 19 is about 4 through 10 times the vertical width of the nozzle 4*a*.

Further, as illustrated in FIG. 4, the length of the linear portion 19 of the nozzle 4*a* (the length in the flow direction of the airflow) increases in the order of A1 to A3. That is, the length of the nozzle 4*a* in the flow direction of the airflow varies in a direction perpendicular to the flow direction. Therefore, the state of development of the flow at the nozzle hole 5 varies, which causes the velocity distribution at the nozzle hole 5 to vary in the longitudinal direction of the nozzle hole 5. As a result, the phases of the pressure variations which constitute the sound source of the vortex noise generated in the nozzle hole 5 are shifted relative to each other in the longitudinal direction of the nozzle hole 5. Thus, the correlation area of sounds can be reduced, and therefore the amount of noise can be reduced.

Although the nozzle 4*a* has been described with reference to FIG. 4, the nozzle 4*b* may have the same shape as the nozzle 4*a* so as to achieve the same effects.

In the above, the method of reducing the amount of noise in the nozzle hole 5 has been described. As mentioned above, another factor concerning the noise of the hand dryer is the noise in the hand insertion section 2 where the opposing airflows emitted from the respective nozzle holes 5 collide with each other. In the hand dryer, upon drying hands, the hands prevent the opposing airflows from the front side and the rear side from colliding with each other. However, the airflows collide with each other in areas where hands are not placed, which results in noise. Accordingly, it is important to reduce the amount of such noise.

Figure 5:
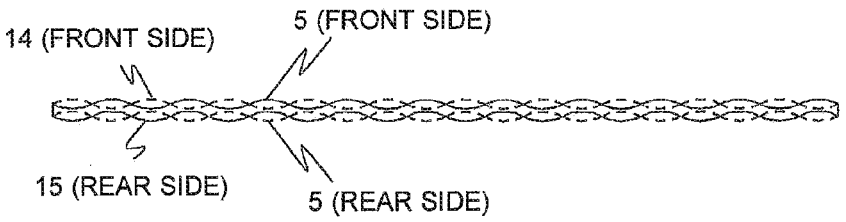
FIG. 5 is a front view of a front-side nozzle hole of the hand dryer of Embodiment 1 of the present invention on which a front view of a rear-side nozzle hole is projected.

FIG. 5 is a front view of the front-side nozzle hole 5 of the hand dryer of Embodiment 1 of the present invention on which a front view of the rear-side nozzle 5 hole is projected.

In order to reduce the amount of the above-described noise due to the collision of the opposing high-speed airflows, the phases of the pressure variations at the collision position need to be shifted relative to each other by making the colliding airflows have different velocities from each other in the longitudinal direction of the nozzle hole. The cross-sectional velocity distribution of the airflow at the downstream side of the nozzle hole 5 is a parabolic curve having the extremum at the center of the nozzle hole 5. If the positional relationship between the nozzle holes 5 and the distance from each nozzle hole 5 to the collision position are changed, the velocities of the colliding airflows are changed. In FIG. 5, the front-side nozzle hole 5 is indicated by the solid line, the rear-side nozzle hole 5 is indicated by the broken line. As illustrated in FIG. 5, the front-side nozzle hole 5 and the rear-side nozzle hole 5 are arranged such that the peak portions and the valley portions of the front-side nozzle hole 5 do not oppose the peak portions and the valley portions, respectively, of the rear-side nozzle hole 5. That is, the peak portions of the front-side nozzle hole 5 and the spaces 14 between the respective adjacent peak portions of the rear-side nozzle hole 5 oppose each other, and the valley portions of the front-side nozzle hole 5 and the spaces 15 between the respective adjacent valley portions of the rear-side nozzle hole 5 oppose each other.

As mentioned above, since the airflows in the space 14 and the space 15 are the induced airflows from the nozzle hole 5, the flow velocity of the airflows is lower than that of the airflow directly emitted from the nozzle hole 5. Therefore, the above-described arrangement of the front-side and rear-side nozzle holes 5 reduces the area of collision between the airflows directly emitted from the respective nozzle holes 5, which can reduce the generation of noise. In the portion shown in FIG. 5 in which the front-side and rear-side nozzle holes 5 oppose each other, that is, in the region between the valley portion and peak portion of each nozzle hole 5, the airflows emitted from the respective nozzle holes 5 directly collide with each other, and therefore the collision velocity is high. However, there is a velocity distribution in the longitudinal direction of the nozzle hole 5. Accordingly, the phases of the pressure variations are shifted relative to each other in the collision position, and therefore the amount of noise due to the collision can be reduced.

Although both the front-side and rear-side nozzle holes 5 have a wave shape in Embodiment 1, one of the nozzle holes 5 may have a linear shape. Even in that case, it is possible to make the phases of the pressure variations which constitute the sound source in the longitudinal direction of the nozzle hole 5 in the collision position differ from each other, and therefore the amount of noise due to the collision can be reduced. Further, the front-side and rear-side nozzle holes 5 may have different pitches between the peaks (or between the valleys) of the wave. Even in that case, it is possible to make the phases of the pressure variations which constitute the sound source in the longitudinal direction of the nozzle hole 5 in the collision position differ from each other, and therefore the amount of noise due to the collision can be reduced.

It is to be noted that arrangement of the nozzle holes 5 of Embodiment 1 is not limited to that shown in FIG. 5 as long as the peak portions and the valley portions of the front-side nozzle hole 5 do not oppose the peak portions and the valley portions, respectively, of the rear-side nozzle hole 5.

A description will be given of a vertical length of the nozzle holes 5 in the case where the nozzle holes 5 are disposed so as to oppose each other. The hand dryer of Embodiments of the present invention is configured such that high-speed airflow from one of the opposing nozzle holes 5 collides with the palm of the hands and high-speed airflow from the other one of the nozzle holes 5 collides with the back of the hands. Thus, the hand dryer blows water droplets off the hands and evaporates the water droplets, thereby drying the hands. However, compared to the backs of the hands, the palms of the hands have a plurality of wrinkles and more easily hold water droplets. Therefore, in order to dry the palms of the hands, the velocity and flow rate of the airflow at the palm side of the hands need to be higher than at the back side of the hands. In order to increase the velocity and flow rate of the airflow at the palm side of the hands, the vertical length of the nozzle hole 5 at the palm side of the hands is made greater than that of the nozzle hole 5 at the back side of the hands. This is because, since the most distal point of the potential core, which is a region where the airflow maintains the same velocity as that near the nozzle hole 5, becomes more distant in proportion to the vertical length of the nozzle hole 5, the velocity and flow rate of the air colliding with the hands increase as the vertical length of the nozzle hole 5 increases.

As described above, it is possible to provide a hand dryer that is capable of reducing the amount of noise without reducing the drying performance due to a nozzle hole having a wave shape, and is capable of preventing foreign substances from entering from an air outlet thereof due to the nozzle hole having a slit shape.

Further, since the nozzle entrance 18 is round-chamfered and the linear portion 19 has an optimum length, the amount of boundary noise can be reduced. Furthermore, since the length of the linear portion 19 of the nozzle 4*a* (the length in the flow direction of the airflow) varies in a direction perpendicular to the flow direction, the amount of vortex noise can be reduced.

Further, since the front-side nozzle hole 5 and the rear-side nozzle hole 5 are disposed so as to reduce the collision area between the airflows directly emitted from the respective nozzle holes 5, the amount of noise due to the collision of the airflows in the hand insertion section 2 can be reduced.

Embodiment 2

Figure 6:
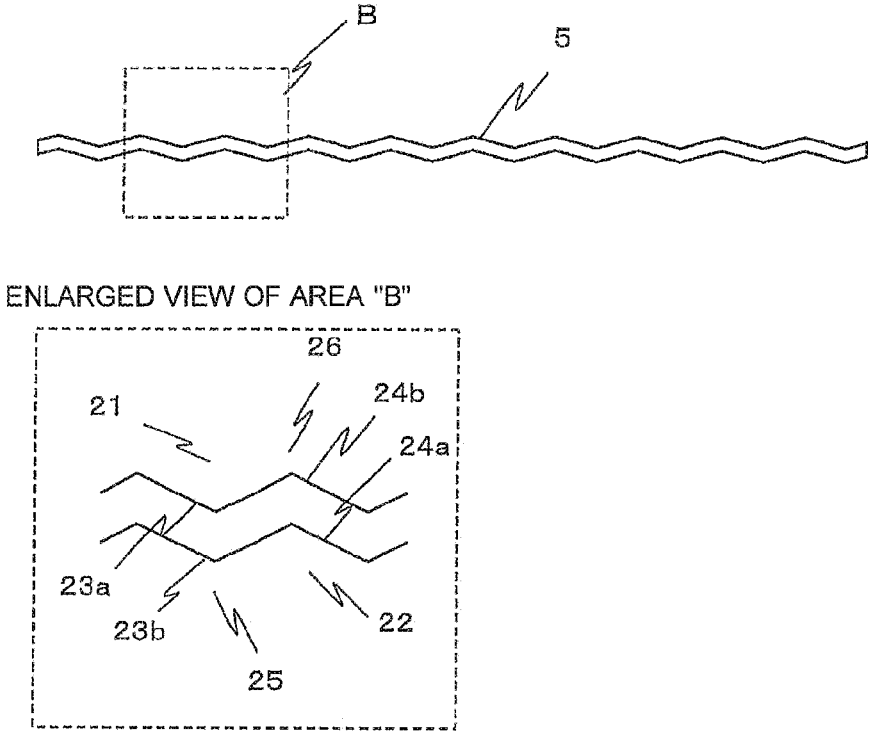
FIG. 6 is a front view of a nozzle hole of a hand dryer according to Embodiment 2 of the present invention.

FIG. 6 is a front view of a nozzle hole 5 of a hand dryer according to Embodiment 2 of the present invention. The configuration and functions of the hand dryer of Embodiment 2 are the same as those illustrated in Embodiment 1, if not otherwise specified.

As illustrated in FIG. 6, the nozzle hole 5 is a wave-shaped (a substantially triangular-wave-shaped) slit having a plurality of peaks and valleys in a longitudinal direction of the nozzle hole 5. Further, as illustrated in an enlarged view of an area "B", each valley portion of the nozzle hole 5 is defined by an outer edge 23*a* at the upper end and an outer edge 23*b* at the lower end. A space 21 is a space surrounded by the outer edge 23*a*. Each peak portion is defined by an outer edge 24*b* at the upper end and an outer edge 24*a* at the lower end. A space 22 is a space surrounded by the outer edge 24*a*.

In the case where the nozzle hole 5 has a sine-wave shape shown in FIG. 3 of Embodiment 1, the lowermost portion of the wave is close to be linear at the outer edge 12*b*, for example. Therefore, as for the energy that causes the surrounding still air to have a speed, the amount of energy supplied to the space 16 is smaller than the amount of energy supplied to the space 14 because the region to which the energy is supplied is limited in the space 16.

On the other hand, in Embodiment 2, the slope portions of the outer edge 23*a* and the outer edge 23*b* are linear, and the lowermost portion of the wave is bent at the outer edge 23*b*. Since the nozzle hole 5 has the shape described above, the area of the space 21 and the space 22 to which a greater amount of energy is supplied is greater than the area of the space 14 and the space 15 shown in FIG. 3. That is, compared to the sine-wave shape shown in FIG. 3, the portion where the velocity difference between the nozzle hole 5 and the surrounding space is large can be reduced, and therefore the amount of jet noise can be reduced.

However, if the effect on the surrounding still air is excessively large, the maximum velocity that affects the drying performance in the hand insertion section 2 might be reduced. Accordingly, the inclination angle or the like of the outer edge 23*a* or the outer edge 24*a* needs to be appropriately selected.

Regarding the side cross-sectional shape of the nozzles 4*a* and 4*b*, as in the case of that shown in FIG. 4 of Embodiment 1, the nozzle entrance 18 may be round chamfered, and the length of the linear portion 19 in the flow direction of the airflow may vary in a direction perpendicular to the flow direction. With this configuration, as in the case of Embodiment 1, it is possible to make the phases of the pressure variations which constitute the sound source of the vortex noise in the longitudinal direction of the nozzle hole 5 differ from each other, and therefore the amount of noise can be further reduced.

Further, with regard to the arrangement of the opposing nozzle holes 5, as in the case of that shown in FIG. 4 of Embodiment 1, the opposing nozzle holes 5 may be arranged such that the peak portions of the front-side nozzle hole 5 and the spaces between the respective adjacent peak portions of the rear-side nozzle hole 5 oppose each other. With this configuration, as in the case of Embodiment 1, the amount of noise due to the collision of the opposing airflows can be reduced.

Although both the front-side and rear-side nozzle holes 5 have a triangular-wave shape in Embodiment 2, one of the nozzle holes 5 may have a linear shape. Even in that case, it is possible to make the phases of the pressure variations which constitute the sound source in the longitudinal direction of the nozzle hole 5 in the collision position differ from each other, and therefore the amount of noise due to the collision can be reduced.

Further, the front-side and rear-side nozzle holes 5 may have different pitches between the peaks (or between the valleys) of the triangular wave. Even in that case, it is possible to make the phases of the pressure variations which constitute the sound source in the longitudinal direction of the nozzle hole 5 in the collision position differ from each other, and therefore the amount of noise due to the collision can be reduced.

As described above, it is possible to provide a hand dryer that is capable of reducing the amount of noise without reducing the drying performance due to a nozzle hole having a triangular-wave shape, and is capable of preventing foreign substances from entering from an air outlet thereof due to the nozzle hole having a slit shape. Further, since the nozzle hole has a triangular-wave shape, compared to the sine-waved nozzle holes, the region where the difference in velocity between the airflow flowing from the nozzle hole and the airflow therearound is small is increased. Thus, the amount of noise can be further reduced.

Embodiment 3

Figure 7:
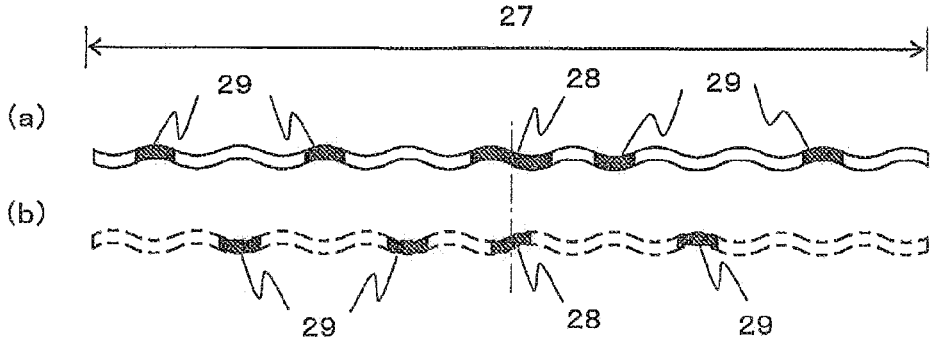
FIG. 7 illustrates a front view of a front-side nozzle hole and a front view of a rear-side nozzle hole of a hand dryer according to Embodiment 3 of the present invention.

FIG. 7 illustrates a front view of a front-side nozzle hole 5 and a front view of a rear-side nozzle hole 5 of a hand dryer according to Embodiment 3 of the present invention. The configuration and functions of the hand dryer of Embodiment 3 are the same as those illustrated in Embodiment 1, if not otherwise specified.

In FIG. 7, (*a*) illustrates a front-side nozzle hole 5, and (*b*) illustrates a rear-side nozzle hole 5. It is to be noted that, as in the case of those shown in FIG. 5 of Embodiment 1, the nozzle holes 5 are arranged such that the peak portions of the front-side nozzle hole 5 and the spaces between the valley portions of the rear-side nozzle hole 5 oppose each other.

In FIG. 7, in the hand dryer of Embodiment 3, since the user inserts both hands into the hand insertion section 2 so as to dry their hands, a width 27 of the nozzle hole 5 is greater than the width of both human hands. In most cases, when the user dries the hands, the hands are not placed near the center of the hand insertion section 2 because the right and left hands meet each other near the center of the hand insertion section 2. That is, the airflow emitted from the area near the center of the nozzle hole 5 into the hand insertion section 2 does not contribute to the drying operation. In order to reduce the amount of noise, the high-speed flow that does not contribute to the drying operation needs to be eliminated as much as possible. Therefore, a center closed region 28 that is closed so as to prevent the airflow from passing therethrough is provided near the longitudinal center of the nozzle hole 5. This makes it possible to reduce, in the hand insertion section 2, the region where the hands of the user are not placed and the opposing airflows collide with each other, and therefore the amount of noise can be reduced.

In the case where the center closed region 28 is provided in the nozzle hole 5, the front-side and rear-side nozzle holes 5 preferably are closed at different areas. Thus, in the region in the hand insertion section 2 between the front-side center closed region 28 and the rear-side center closed region 28, a low-speed flow is generated by dispersion of the surrounding high-speed airflow. In the case where the front-side and rear-side center closed regions 28 are provided in the same area, there will be a region where no airflow is present. Thus, for certain users who insert their hands in that region so as to dry their hands, the hands might not be sufficiently dried.

Further, in the nozzle hole 5, closed regions 29 which prevent the airflow from being emitted are preferably provided in specific small areas other than the center closed region 28. Thus, in the hand insertion section 2, positions where the high-speed airflows collide with each other and positions where the high speed airflows do not collide with each other are randomly present in the width direction of the nozzle. This makes it possible to prevent the phases of the noise due to the collision in the longitudinal direction of the nozzle hole 5 from being matched with each other, and thus to prevent the noise from being amplified. Therefore, the amount of noise can be reduced. The closed regions 29 of the front-side nozzle hole 5 and closed regions 29 of the rear-side nozzle hole 5 are preferably positioned so as not to oppose each other. This is because, if the closed regions 29 are positioned so as to oppose each other, no airflow will be present in certain portions of the hand insertion section 2. Thus, the hands of the user might not be sufficiently dried.

If the closed region 29 which prevents the high-speed airflow from being emitted is excessively large, the width of the high-speed airflow that blows water off from the hands so as to dry the hands is reduced. This causes a reduction in drying performance. For this reason, the closed region 29 which prevents the high-speed airflow from being emitted is preferably not too large.

As described above, since the center closed region 28 which prevents airflow from being emitted is provided in the nozzle hole 5, collision between airflows is reduced. Therefore, the amount of noise can be reduced. Further, since the closed regions 29 other than the center closed region 28 are provided in the nozzle hole 5, it is possible to prevent the phases of the noise due to the collision in the longitudinal direction of the nozzle hole 5 from being matched with each other, and thus to prevent the noise from being amplified. Therefore, the amount of noise can be reduced.

The nozzle hole 5 of Embodiment 3 having a wave shape may have a triangular-wave shape shown in FIG. 6 of Embodiment 2. Even with such a nozzle hole 5, if a region which prevents airflow from being emitted is provided as described, the amount of noise can be reduced.

Although the positions of the closed regions 29 are not symmetric with respect to the center closed region 28 in the lateral direction (the longitudinal direction) in FIG. 7, the positions of the closed regions 29 may be symmetric with respect to the center closed region 28 from the viewpoint of drying performance.

Embodiment 4

Figure 8:
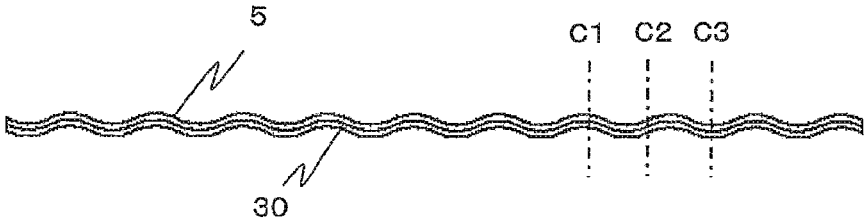
FIG. 8 is a front view of a nozzle hole of a hand dryer according to Embodiment 4 of the present invention.
Figure 9:
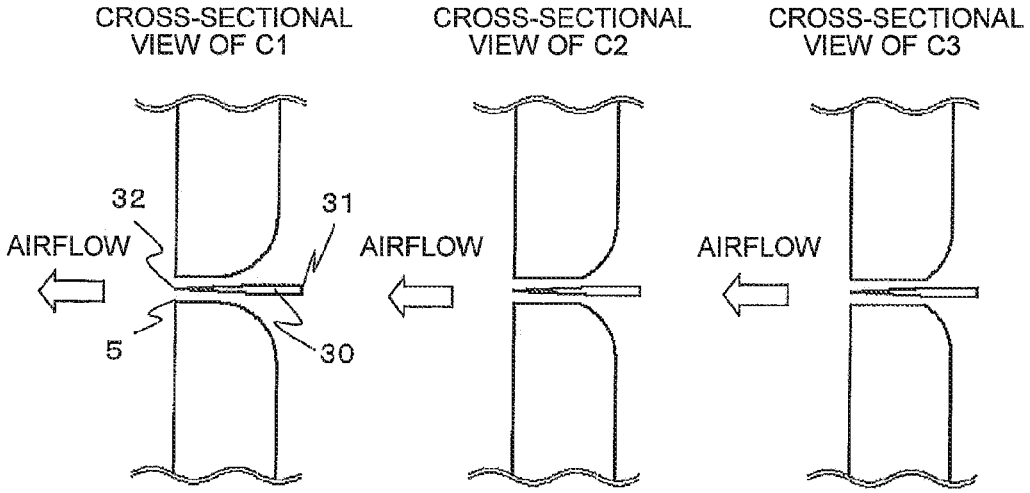
FIG. 9 illustrates cross-sectional views taken along the lines C1, C2, and C3, respectively, of FIG. 8.

FIG. 8 is a front view of a nozzle hole 5 of a hand dryer according to Embodiment 4 of the present invention, and FIG. 9 illustrates cross-sectional views taken along the lines C1, C2, and C3 of FIG. 8. The configuration and functions of the hand dryer of Embodiment 4 are the same as those illustrated in Embodiment 1, if not otherwise specified.

In FIG. 8, similar to one shown in FIG. 3 of Embodiment 1, the nozzle hole 5 has a wave shape. However, a partition plate 30 partitioning the nozzle hole 5 in the vertical direction is provided near the vertical center of the nozzle hole 5. The partition plate 30 is parallel to the wave-shaped nozzle hole 5 as viewed from the front. Further, as illustrated in FIG. 9, the partition plate 30 has a cross-sectional shape such that the vertical width thereof gradually increases from an exit side 32 of the nozzle hole 5 toward an entrance side 31 of the nozzle hole 5.

Further, when airflow is emitted from the nozzle hole 5 shown in FIGS. 8 and 9, high-speed airflow is emitted from each of the upper and lower sides of the exit side 32 of the partition plate 30. Generally, if high-speed airflows having two-dimensional velocity distributions exist adjacent to each other, jet flows of the respective airflows reinforce each other so as to form a higher-speed jet flow. Therefore, the jet flow velocity of a combined jet flow formed by a combination of the two jet flows is greater at some distance away from the nozzle hole 5 compared to the velocity of airflow being emitted from the nozzle hole 5 not having a partition plate 30. That is, the velocity in the hand insertion section 2 is high, and therefore the capacity of blowing water droplets off the hands and drying the hand is increased. Accordingly, it is possible to dry the hands in a shorter amount of time.

On the other hand, in the case where the nozzle hole 5 of Embodiment 4 is used so to obtain the same velocity as the jet flow velocity in the hand insertion section 2 which is obtained with a single nozzle hole 5, the flow velocity near the exit of the nozzle hole 5 can be reduced. That is, by using the nozzle hole 5 of Embodiment 4, it is possible to achieve the same drying performance even if the jet flow velocity near the exit of the nozzle hole 5 is lower. The amount of noise generated from the nozzle hole 5 increases with the fifth power through sixth power of the exit velocity of the nozzle hole 5. In Embodiment 4, since the partition plate 30 is provided in the nozzle hole 5, the amount of noise of the hand dryer can be reduced.

Although the nozzle hole 5 of Embodiment 4 has been illustrated as a nozzle hole having a substantially sine-wave shape, the nozzle hole 5 having a triangular-wave shape illustrated in Embodiment 2 may be used. Even in that case, the same noise reducing effect as that described above can be achieved. Further, a part of the nozzle hole 5 may be closed as illustrated in Embodiment 3. Even in that case, the same noise reducing effect as that described above can be achieved.

Embodiment 5

Figure 10:
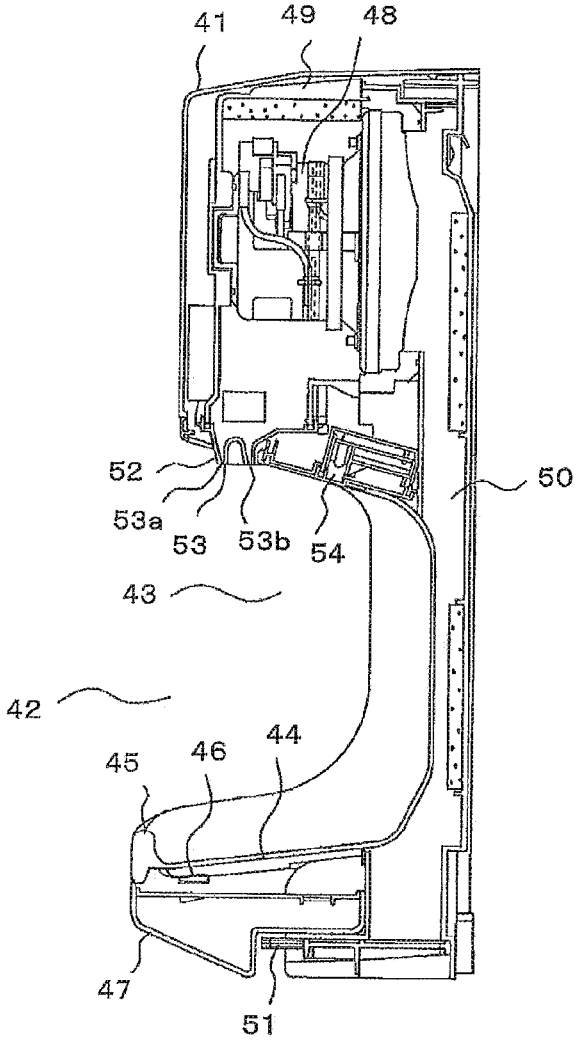
FIG. 10 is a vertical cross-sectional view of a hand dryer according to Embodiment 5 of the present invention.

FIG. 10 is a vertical cross-sectional view of a hand dryer according to Embodiment 5 of the present invention.

As illustrated in FIG. 10, a case 41 defining the outer shape includes a hand insertion opening 42 in the front thereof, and a hand insertion section 43 as a treatment space continuous with the hand insertion opening 42, thereby allowing hands to be inserted and removed. The hand insertion section 43 is formed as a recess having the shape of an open sink that is open at the front and both sides, in the lower front (left direction in the drawing) part of the case 41. Further, a protective wall structure 45 as an upright curved surface is provided at the edges of a water receiving portion 44 defining the lower part and at the far side (the right direction in the drawing) so as to prevent water from being blown toward the lateral sides and the front side. The bottom of the water receiving portion 44 is downwardly sloped toward the front. A drain outlet 46 is provided at the lower end of the slope.

A drain container 47 for storing water dropped from the drain outlet 46 is removably inserted under the water receiving portion 44. The inner surface of the hand insertion section 43 is impregnated with a water-repellent coating of the silicone series, the fluorine series or the like; a hydrophilic coating of titanium oxide or the like; or an antimicrobial agent. This reduces adhesion of contaminants to the inner surface and prevents the growth of bacteria.

A high-pressure airflow generating device 48 is mounted in the case 41. The high-pressure airflow generating device 48 includes a DC brushless motor (which may alternatively be a regular commutator motor or an induction motor), a drive circuit for driving the DC brushless motor, and a turbofan rotated by the DC brushless motor. The high-pressure airflow generating device 48 is attached directly above the hand insertion section 43 of the case 41. The suction side of the high-pressure airflow generating device 48 faces a suction passage 50 provided in the proximity of the far-side rear surface of the hand insertion section 43 at the rear side of the case 41. The suction passage 50 extends vertically, and is open at the lower end thereof. Thus, the high-pressure airflow generating device 48 can suction air through a detachable air filter 51 from the lower end of the suction passage 50.

The high-pressure airflow generating device 48 has a plurality of air outlets with intervals therebetween in the circumferential direction at the outer periphery of a circular-cup-shaped fan casing. The air outlets are open in the radius direction. The outer side of the fan casing is covered with a circular-cup-shaped casing 49 having a guide passage extending in a rotational direction of the turbofan. A nozzle 52 that converts high-pressure air sent from the high-pressure airflow generating device 48 into high-speed airflow and blows the airflow into the hand insertion section 43 is connected to an end of the guide passage of the casing 49.

The nozzle 52 is attached, with a blowing opening facing downward, to an upper portion near the hand insertion opening of the hand insertion section 43. The nozzle 52 blows high-speed airflow for blowing water off the hands inserted in the hand insertion section 43 from nozzle holes 53*a* and 53*b* formed in the nozzle 52. Thus, the airflow removes water droplets from the surface of the hands and blows off the water droplets without requiring the user to rub their hands together. It is to be noted that a hand detection sensor 54 is provided behind the nozzle 52 so as to face the hand insertion section 43. The hand detection sensor detects insertion and removal of the hands.

A nozzle hole 53 is provided at a distal end of the nozzle 52. The nozzle hole 53 is oriented such that the width direction of the case 41 (the front-rear direction of the paper of FIG. 10) corresponds to the longitudinal direction of the nozzle hole 53. Similar to the nozzle hole 5 shown in FIG. 3 of Embodiment 1, the nozzle hole 53 may be formed as a slit having a wave shape, for example. Further, the nozzle hole 53 is formed of two arrays of nozzle holes, namely, the first nozzle hole 53*a* and the second nozzle hole 53*b*, in the front-rear direction of the case 41 (the lateral direction of the paper of FIG. 10). It is obvious that the nozzle hole of Embodiment 5 may be formed of one array or may be formed of three or more arrays.

It is to be noted that the noise reducing effect of the wave-shaped nozzle holes 53*a* and 53*b* is the same as that of the nozzle hole 5 of Embodiment 1, and therefore a description thereof is omitted.

As described above, even in the hand dryer of Embodiment 5 in which nozzle holes are not arranged so as to oppose each other, since the nozzle hole has a wave shape, it is possible to reduce the amount of noise as in the case of the hand dryers of Embodiments 1 and 2.

The nozzle 52 may have the same shape as the nozzle 4*a* illustrated in FIG. 4 of Embodiment 1 so as to achieve the same effects.

Further, the nozzle hole 53*a* and the nozzle hole 53*b* may have the triangular-wave shape illustrated in FIG. 6 of Embodiment 2 so as to achieve the same effects.

REFERENCE SIGNS LIST

1 case; 2 hand insertion section; 2*a*, 2*b* opening portion; 4*a*, 4*b* nozzle; 5 nozzle hole; 6 blower; 7, 8 space; 9 air inlet; 12*a*, 12*b*, 13*a*, 13*b* outer edge; 14, 15, 16, 17 space; 18 nozzle entrance; 19 linear portion; 21, 22 space; 23*a*, 23*b*, 24*a*, 24*b* outer edge; 25, 26 space; 27 width; 28 center closed region; 29 closed region; 30 partition plate; 31 entrance side; 32 exit side; 41 case; 42 hand insertion opening; 43 hand insertion section; 44 water receiving portion; 45 protective wall structure; 46 drain outlet; 47 drain container; 48 high-pressure airflow generating device; 49 casing; 50 suction passage; 51 air filter; 52 nozzle; 53, 53*a*, 53*b* nozzle hole; and 54 hand detection sensor.

The invention claimed is:

1. A hand dryer configured to blow water off hands with an airflow, the hand dryer comprising:

a hand insertion section that is open toward the outside; and a nozzle disposed on a wall surface of the hand insertion section for emitting the airflow, wherein a nozzle hole at a distal end of the nozzle is a wave-shaped slit having alternating crests and troughs as seen in a direction into the nozzle hole.

2. The hand dryer of claim 1, wherein the hand insertion section includes a plurality of wall surfaces that oppose each other; and wherein the nozzle is provided on each of a first wall surface among the wall surfaces of the hand insertion section and a second wall surface among the wall surfaces of the hand insertion section, the second wall surface opposing the first wall surface.

3. The hand dryer of claim 2, wherein each nozzle hole is arranged such that crests of the nozzle hole of the first wall surface and crests of the nozzle hole of the second wall surface do not oppose each other, and such that troughs of the nozzle hole of the first wall surface and troughs of the nozzle hole of the second wall surface do not oppose each other.

4. The hand dryer of claim 3, wherein each nozzle hole is arranged such that the crests of the nozzle hole of the first wall surface and spaces between the respective adjacent crests of the nozzle hole of the second wall surface oppose each other, and such that the troughs of the nozzle hole of the first wall surface and spaces between the respective adjacent troughs of the nozzle hole of the second wall surface oppose each other.

5. The hand dryer of claim 2, further comprising:

a closed region provided at a part of at least one of the nozzle holes of the first wall surface and the second wall surface for preventing the airflow from being emitted.

6. The hand dryer of claim 2, further comprising:

a partition plate provided in at least one of the nozzle hole of the first wall surface and the nozzle hole of the second wall surface for partitioning the nozzle hole in a vertical direction of the nozzle hole.

7. The hand dryer of claim 2, wherein pitches between the crests or between the troughs of the nozzle of the first wall surface are different from pitches between the crests or between the troughs of the nozzle of the second wall surface.

8. The hand dryer of claim 1, wherein the nozzle hole is a substantially sine-wave-shaped slit.

9. The hand dryer of claim 1, wherein the nozzle hole is a substantially triangular-wave-shaped slit.

10. The hand dryer of claim 1, the nozzle includes a linear portion on an exit side of the airflow; and wherein a length of the linear portion in a flow direction of the airflow varies in a direction perpendicular to the flow direction.

11. The hand dryer of claim 1, wherein a closed region which prevents the airflow from being emitted is provided at a part of the nozzle hole.

12. The hand dryer of claim 11, further comprising:

a center closed region provided at a longitudinal center portion of the nozzle hole for preventing the airflow from being emitted.

13. The hand dryer of claim 1, further comprising:

a partition plate provided at the nozzle hole for partitioning the nozzle hole in a vertical direction of the nozzle hole.

* * * * *